United States Patent [19]

Gallagher

[11] 3,992,975

[45] Nov. 23, 1976

[54] PROSTHETIC GUITAR PICK

[76] Inventor: Evan Patrick Gallagher, 509 Rock Glen Road, Baltimore, Md. 21229

[22] Filed: Oct. 8, 1975

[21] Appl. No.: 620,848

[52] U.S. Cl. ..... 84/322

[51] Int. Cl.[2] ..... G10D 3/16

[58] Field of Search ..... 84/322, 320, 327, 328

[56] References Cited

UNITED STATES PATENTS 408,052 7/1889 Stoll ..... 84/322

FOREIGN PATENTS OR APPLICATIONS 17,843 4/1882 Germany ..... 84/322

*Primary Examiner*—Stephen J. Tomsky

*Attorney, Agent, or Firm*—Walter G. Finch

[57] ABSTRACT

The invention is a plectrum or pick for a guitar or other stringed musical instrument played with a pick. In particular, the invention is a pick and pick holder conformable to the contours of the forearm of a wrist amputee, the invention also providing a method for making the present prosthetic pick structure.

6 Claims, 3 Drawing Figures

PROSTHETIC GUITAR PICK

BACKGROUND AND SUMMARY OF THE INVENTION

1. Field of the Invention

The invention relates to guitar pick devices and particularly to the article and the method for making a prosthetic guitar pick formable to the contours of the wrist or lower arm of the disabled individual.

2. Description of the Prior Art

In the playing of guitars and other like stringed musical instruments, a hand held pick or plectrum is used to pluck the strings by appropriate manual manipulations to produce musical sounds. While the prior art has not been provided which would enable an individual who is disabled at the lower extremity of his arm, i.e., at the hand or lower wrist, to play such a stringed instrument. Disability of the nature ranges from amputation of the individual's fingers, hand, or lower arm at one extreme to nervous or muscular disorders which render the fingers and hand from successfully grasping a guitar pick with sufficient power to enable playing of such an instrument with the pick. The present invention therefore provides a guitar pick of a prosthetic nature which allows an individual who is disabled as described above to play a stringed musical instrument. Further, the invention provides a method for making such a prosthetic guitar pick whereby the finished article can be configured to conform to the particular contours of the users' body surfaces on which the present device is disposed.

SUMMARY OF THE INVENTION

The present prosthetic guitar pick is comprised of a pick element embedded in a hardened mass of material, such as dental clay, the assembly thus formed being held with a casing or pouch which is strapped to the wrist or lower arm of a user. The pick element extends through a slot in the casing on the inner side of the arm and toward the body of the user so that the pick element can be brought into contact with the strings of a guitar or like instrument which is being held in the usual position transversely across the body of said user. The present prosthetic pick can be fabricated with a generalized contour over the inner surface of the mass of material in which the pick element is embedded and provided to a user as a finished article. Alternatively, the pick assembly can be formed effectively on the wrist or lower arm of the potential user according to the method disclosed hereinafter to provide a prosthetic pick wherein that surface of the hardened mass of material which is nearest to the part of the arm on which the pick assembly is attached is shaped in situ to the shape of the arm. Thus, the pick assembly positively conforms to the contours of the lower arm onto which the assembly is strapped to prevent slippage of the pick assembly when in use and to render greater comfort for the user.

It is therefore an object of the invention to provide a prosthetic pick useful for playing of guitars and other stringed instruments by individuals having lower arm disabilities which prevent grasping of an ordinary pick.

It is a further object of the invention to provide a method for making a prosthetic guitar pick so that the structure holding the pick element conforms to the contours of the lower arm on which the prosthetic is held.

Further objects and advantages of the invention will become more readily apparent in light of the following detailed description of the preferred embodiments of the invention.

DESCRIPTION OF THE PREFERRED EMBODIMENTS

Figure 1:
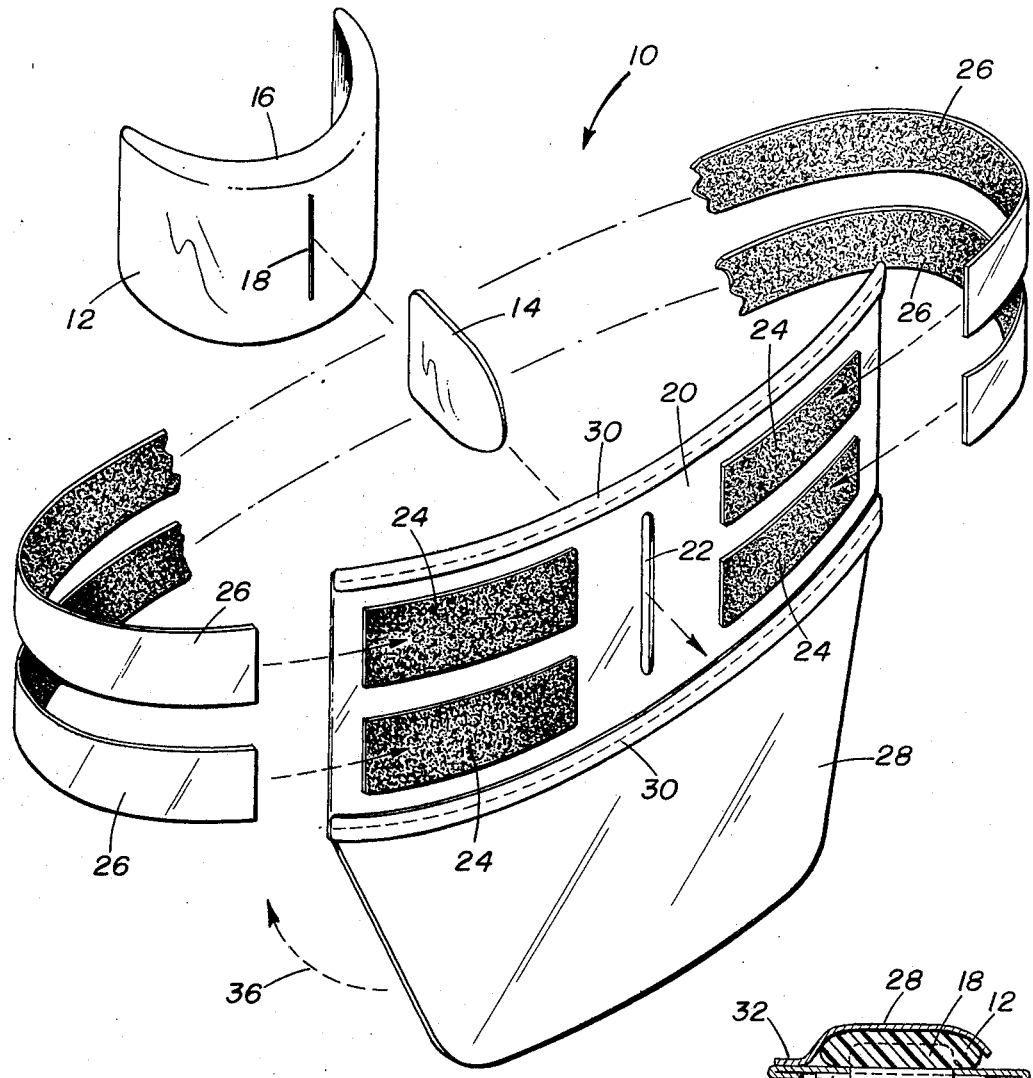
FIG. 1 is an exposed view illustrating the several elements forming the invention and the relationship thereof on assembly of the structure.

Referring first to FIG. 1, the present prosthetic article is seen at 10 to comprise a pick element 14 and a shaped mass of hardenable material which will hereinafter be referred to as the mold 12. The mold 12 can be formed of a material such as dental clay or other material which is plastic and moldable in the uncured or undried state and which hardens or dries to a rigid, non-plastic state. The mold 12 is shaped with an arcuate curvature as seen at 16 to conform generally to the contour of the inner portion of the lower arm. As will be more fully described hereinafter, the contour of the mold 12 at 16 can be shaped in situ to conform to the bodily contours of a particular user at that portion of the arm and/or hand to which the article 10 is attached.

Figure 3:
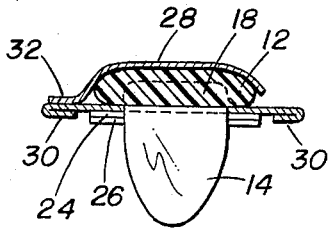

When the mold 12 is in a plastic or moldable state, the inner end portion of the pick element 14 is embedded into the outer face of the mold 12 such as at 18. The assembly thus resulting can be hardened prior to completing fabrication of the article 10 or can be processed in a manner to be described hereinafter. In either event, the assembly formed by the mold 12 and pick element 14 is eventually placed within a casing 20 formed of a main body portion and a flap 28 attached thereto. The casing 20 and flap 28 may preferably be formed of a leather-like material, the main body portion of the casing 20 being reinforced if desired to render a desirable degree of stiffness to the casing 20. The casing 20 has a transverse slot 22 formed medially in the main body portion thereof, the pick element 14 being inserted into and through the slot 22. The mold 12 carrying the pick element 14 is thus enclosable within the casing 20 by folding the flap 28 around the mold 12 as shown at 36 and sewing or otherwise attaching the flap 28 to the main body portion of the casing 20 such as at 32 to effectively encapsulate the mold 12 and to hold the pick element 14 in a position where said pick element extends outwardly from the outer face of the casing 20 as particularly seen in FIG. 3. The casing 20 may be folded and sewn such as at 30 to further provide torsional stiffness to their main body portion thereof.

Figure 2:
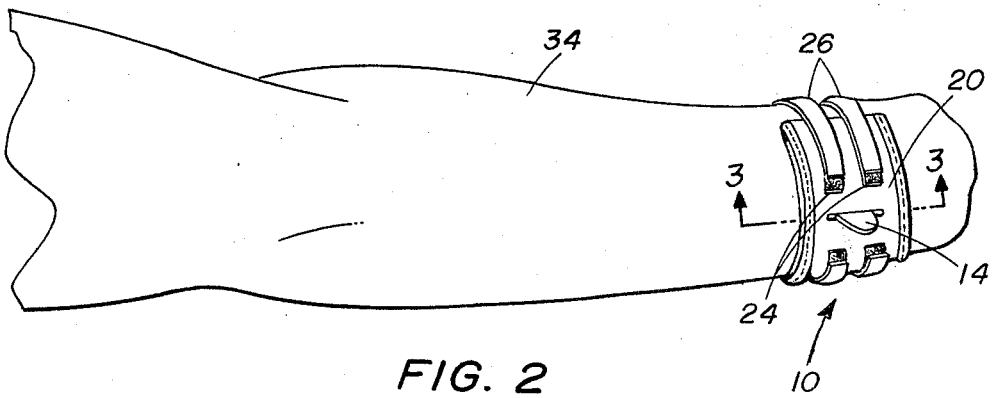
FIG. 2 is a perspective of the invention attached to the lower arm of a user; and, FIG. 3 is an idealized section taken along line 3—3 of FIG. 2.

As can be seen in FIGS. 1 and 2, the casing 20 has fabric fasteners 24 attached to the outer face of the main body portion thereof, the fasteners 24 conveniently being of the "Velcro" or hook type. The fasteners 24 are aligned with their longitudinal axes parallel to the longitudinal axis of the casing 20 so that straps 26 can be mated with the fasteners 24, the straps 26 extending about the arm 34 of a user to hold the prosthetic article 10 on the arm 34 at a desired location. A user of the article 10 can thus move the extending pick element 14 relative to the strings of a guitar or like musical instrument to contact the strings and produce ordered, controllable musical sounds.

In the fabrication of the prosthetic article 10, it is possible to make said article so that the surface of the mold 12 which is nearest to the arm 34 will conform exactly to the contours of the particular users' arm over the portion thereof on which the article ten is attached. This advantageous situation is provided by enclosing the mold 12 within the casing 20 as described while the mold 12 is still in a plastic or nonhardened state. The enclosed mold 12 is then positioned on the arm 34 of a user at the location on which the prosthetic article 10 is to be worn. Pressure applied to the mold 12 through the covering flap 28 forms the inner surface of the mold 12 into the desired contour. Depending on the physical state of the mold 12, the encapsulated mold can be immediately removed and left to harden or can be strapped to the arm to harden thereon. The article 10 when thus formed conforms to the specific contours of the users' arm and is thereby less subject to slippage when in use and is more comfortable to the user.

It is to be understood that the invention can be practiced other than is described expressly hereinabove without departing from the scope of the invention as defined by the appended claims.

What is claimed is:

1. A prosthetic article mounting a pick which is useful for playing stringed musical instruments and the like, the prosthetic article being adapted to at least a portion of the lower extremity of the users' arm, the prosthetic article comprising:

mold means rigidly mounting the pick;

casing means for holding the mold means; and, strap means adapted to conform to and attach the casing means to the arm of a user of the article, the pick extending outwardly from the casing and mold means and being engageable with and movable relative to the strings of a stringed musical instrument.

2. The prosthetic article of claim 1 wherein the mold means is formed of a shaped mass of hardenable material and the pick is at least partially embedded into one face of the mold means the opposite face of the mold means being shaped to conform to the contours of that portion of a users' arm on which the article is worn.

3. The prosthetic article of claim 2 wherein the casing means encloses the mold means and further has a slot in an outwardly facing portion, at least a portion of the pick extending through the slot and externally of the casing means.

4. The prosthetic article of claim 3 wherein the casing means has a flap portion which folds over the aforesaid opposite face of the mold means to enclose said mold means, the flap portion being adapted to contact the surface of the arm of a user of the article and to conform along with the opposite face of the mold means to the aforesaid contours of the user's arm.

5. The prosthetic article of claim 1 wherein the strap means comprise fastener means attached to the casing means and at least one strap member adapted to extend about the arm of a user of the article and to fasten to the fastener means, thereby to attach the article to the arm of the user.

6. The prosthetic article of claim 5 wherein the fastener means and strap member have fabric hook-like material on mating portions thereof to provide quick attachment and removal of the article.

* * * * *